US006250988B1

(12) United States Patent
Fleet

(10) Patent No.: US 6,250,988 B1
(45) Date of Patent: Jun. 26, 2001

(54) HAND MANIPULABLE DEVICE

(75) Inventor: Patrick Fleet, Toronto (CA)

(73) Assignee: Martin Fleet, Toronto (CA)

( * ) Notice: Subject to any disclaimer, the term of this patent is extended or adjusted under 35 U.S.C. 154(b) by 0 days.

(21) Appl. No.: 09/404,818

(22) Filed: Sep. 24, 1999

(51) Int. Cl.[7] ..... A63H 33/00
(52) U.S. Cl. ..... 446/486
(58) Field of Search ..... 446/486, 487, 446/490; 273/158, 159

(56) References Cited

U.S. PATENT DOCUMENTS

| | | | | |
|---|---|---|---|---|
| 708,242 | * | 9/1902 | Moseley . | |
| 872,717 | * | 12/1907 | Davis . | |
| 2,738,616 | * | 3/1956 | Windle . | |
| 2,952,460 | * | 9/1960 | Ellis . | |
| 3,219,342 | * | 11/1965 | Melchiona . | |
| 3,547,112 | * | 12/1970 | Courtney . | |
| 3,884,462 | * | 5/1975 | Rebajes . | |
| 4,214,747 | * | 7/1980 | Rebajes . | |
| 4,335,539 | * | 6/1982 | Jones . | |
| 4,384,717 | * | 5/1983 | Morris . | |
| 4,632,384 | * | 12/1986 | Bright . | |
| 4,725,627 | * | 2/1988 | Arnason et al. . | |
| 5,092,272 | * | 3/1992 | O'Rourke . | |
| 5,413,519 | * | 5/1995 | Simon | 446/487 |
| 5,735,781 | * | 4/1998 | Pai . | |
| 5,782,668 | * | 7/1998 | Chabert . | |

FOREIGN PATENT DOCUMENTS

26499000 * 6/1989 (FR) .

OTHER PUBLICATIONS

Pp. 994, 995, 996, 997, 998, 999 and 1833 from book entitled CRC Concise Encyclopedia of Mathematics by Eric W. Weisstein, published, Boca Raton, Florida, CRC Press, 1999.

Screen display taken from website: http://www.math.virginia.edu/~chg4k/Knots/Trefoil.html Listed as Last Modified May 30, 1999.

Single screen dowloaded on Nov. 17, 1999 at 3:40 p.m. from a "moving" depiction.

* cited by examiner

*Primary Examiner*—David T. Fidei
(74) *Attorney, Agent, or Firm*—Bereskin & Parr

(57) ABSTRACT

A device which may be manipulated by the hand is useful as a toy and as an exercising device to rebuild motor skills and rebuild muscles and flexibility. The device comprises an elongate, endless member of a particular shape. The shape comprises a plurality of loops with a portion of the member passing through each loop. The device may be manipulated by bending the loops over one another or by deforming the loops along the general axis of the member so that a point on the member appears to move along the member in wave-like fashion. The member is flexible and resilient so that it may be deformed, but when released, assumes its initial shape. The initial shape may be dictated by a combination of resilience and contact between portions of the member or by the "memory" of the member.

9 Claims, 4 Drawing Sheets

HAND MANIPULABLE DEVICE

FIELD OF THE INVENTION

This invention relates in general to the field of device intended for manipulation by the hand. More particularly, the present invention relates to a device which may be used as a toy or game, or alternatively, may be used to develop motor co-ordination skills and serve as an exercise device for the hand

BACKGROUND OF THE INVENTION

There are many devices which may be used to establish muscle co-ordination and/or joint flexibility of the hand. These devices may be used in rehabilitation following surgery, accidents or the like. There are also devices which can be used to be manipulated by the hand simply as a toy or diversion. Such devices include strings of beads or the like which involve endless strings that are simply manipulated back and forth through the hand. Such repetitive motion of the hand serves as a means for displacing an anxious state of mind and have a very soothing effect on the person performing multiple repetitive manipulations. Such repetitive multiple manipulations are also useful in exercising the fingers and joints of the hand. Such devices thus serve to exercise the hand and can be used to build motor skills or to rebuild muscles and flexibility in the hand following injury or medical treatment and the like.

SUMMARY OF THE INVENTION

An object of the present invention is to provide a device for manipulation of the hand.

Another object of the present invention is to provide a toy which may be manipulated by the hand continuously.

In accordance with this invention, a hand manipulable device comprises an endless elongate member having a particular shape. The shape comprises a plurality of sections comprising a loop configuration having a general radius of curvature of the loop configuration and having a first portion of the loop configuration overlying a second portion of the loop configuration and a third portion of the endless member extends through the loop configuration. The endless member is flexible and has resilience and the resilience is such that the general radius of curvature of the loop configuration would tend to increase if the member were not continuous.

In accordance with an alternative embodiment of the invention, a hand manipulable device comprises an endless elongate member having a particular shape. The shape comprises a three dimensional curve in which each finite element of the curve has the same configuration. Generally, the curve comprises a plurality of three dimensional loops with each such loop having a portion of the endless member extending through the loop.

BRIEF DESCRIPTION OF THE DRAWINGS

The invention and its method of manufacture and use may be further understood from reference to the attached drawings which illustrate preferred embodiments of the invention and in which:

With reference to FIG. 1, it will be noted that the device illustrated generally at 10 comprises an elongated endless member 12. The elongate endless member 12 has a particular shape.

The shape of the device is most easily understood by reference to FIG. 3. FIG. 3 illustrates a portion of the device of FIG. 1. The particular shape involves a plurality of sections of the endless elongate member 12. FIG. 3 illustrates one such section indicated generally at 14. The section 14 comprises a loop configuration 16. The loop configuration 16 has a general radius of curvature R. It will be observed from reference to FIG. 3 that the loop configuration 16 is not exactly circular. Nevertheless, the inner surface of the member defines a curve which may be approximated as a substantially uniform curve of radius R indicated by the line labelled R in FIG. 3.

Figure 3:
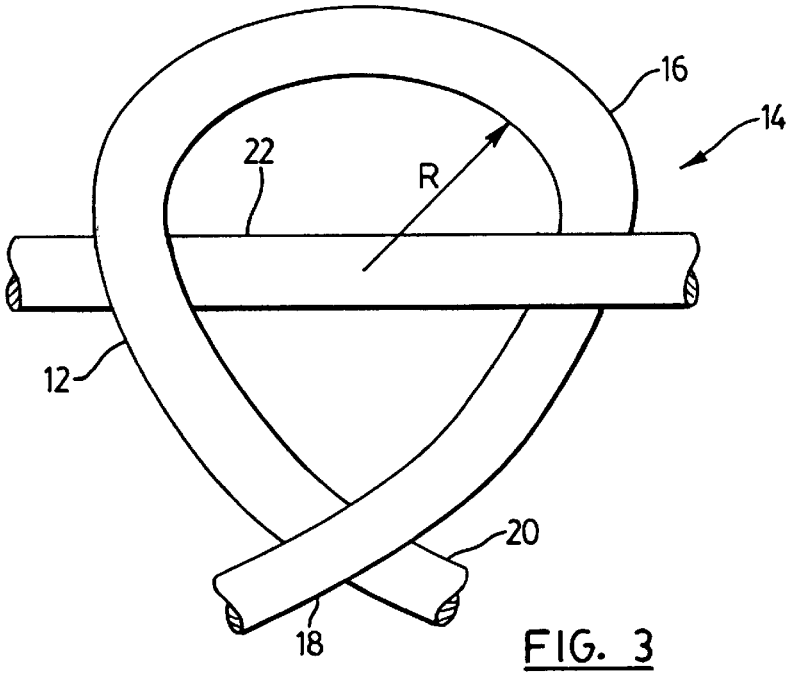
FIG. 3 illustrates a portion of the device illustrated in FIG. 1.

The loop configuration has two portions 18 and 20. Portion 18 overlies portion 20. A third portion 22 of the member 12 is illustrated in FIG. 3. The third portion 22 of the endless member 12 extends through the loop configuration 16. The third portion 22 is shown having indefinite length. Similarly, the portions 18 and 20 are also shown as having indefinite length.

Figure 1:
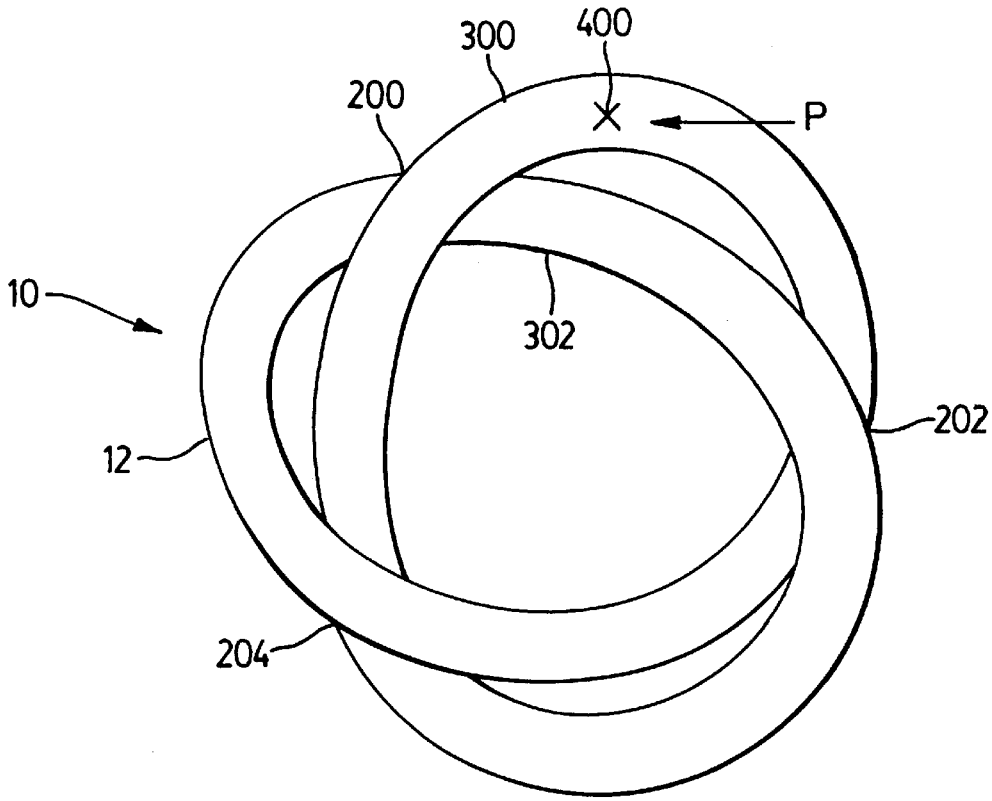
FIG. 1 illustrates a first embodiment of the invention.
Figure 4:
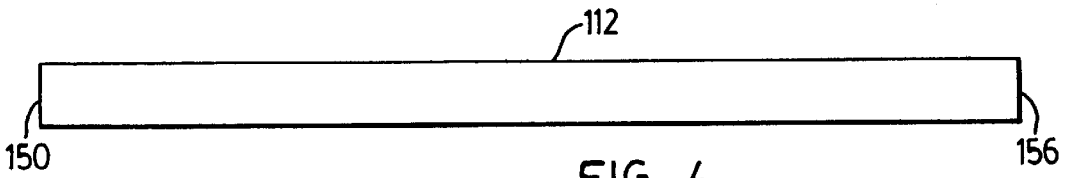
FIG. 4 illustrates a length of material suitable for manufacturing the device illustrated in FIG. 1.
Figure 5A:
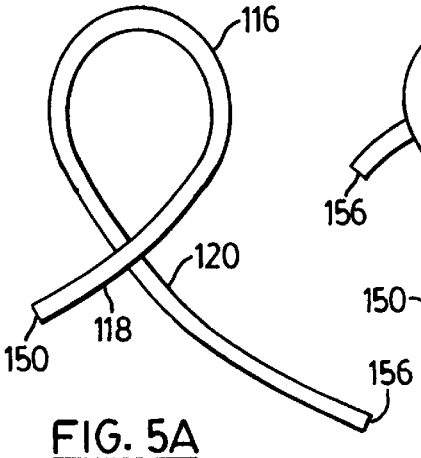
FIGS. 5A, B and C illustrate the steps taken to manufacture the device illustrated in FIG. 1 from the length of material illustrated in FIG. 4.
Figure 5B:
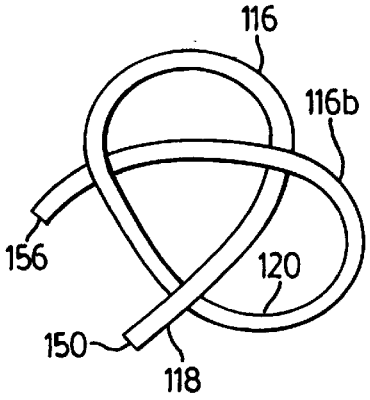
Figure 5C:
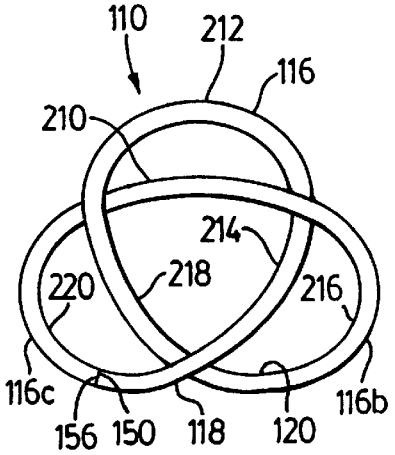

FIG. 4 illustrates an endless elongate member 112 having ends 150 and 156 which may be utilized in the manufacture of the device illustrated in FIG. 1. In order to create the particular shape, the elongate member 112 is tied into what is essentially a knot configuration following the steps laid out in FIGS. 5A, B and C. The first step in the manufacture of the device as shown in FIG. 1 is to form a loop configuration 116 with a first portion 118 overlying a second portion 120. The overlying portion 118 is constructed substantially near to one end 150 of the member 112. The second stage in the creation of the device 110 is to pass the end 156 over the loop configuration 116 and end 156 through the loop configuration 116 as shown in FIG. 5B. This creates a second loop 116*b*. The next step in the manufacture is shown in FIG. 5C where the ends 156 and 150 are brought into registry with one another and joined. The particular technique used to join the ends will depend upon the material from which the endless elongate member is comprised. Upon joining the ends 156 and 150 together, the member 112 has been formed into a single endless elongate member. Upon joining the ends 156 and 150, there is created a third loop configuration 116C. From review of FIG. 5C it will be realized that the device 110 shown therein comprises three loop configurations 116, 116*b* and 116*c*. Each loop has a first portion overlying a second portion and a portion of the endless member 112 extends through the loop.

The endless elongate member may be made from a number of suitable materials. The member must be flexible so that the device can be manipulated readily by hand. Flexibility of the member 12 or 112 can be an inherent property in the material from which the member is made or may arise from the construction of the member. The member 12 or 112 could be made from a mechanical assembly of components having a plurality of hinges which permit flexibility of the resulting member. Thus the structure similar to that used as the strap for a wrist watch could be used provided that sufficient flexibility is included in the structure. Alternatively, the flexibility could be an inherent property of the material from which the elongate member is made. Suitable materials would include metals which inherently would have appropriate flexibility. The amount of flexibility would, of course, depend upon the particular metal chosen and the structure, that is whether the elongate member is a tubular member or a thin solid member, the wall thickness of the tubular members and the like. The elongate member could also be made of plastic material. The word "plastic" is used in this disclosure and in the appended claims to describe any of the polymeric materials such as polyethylene, polypropylene, polyamides, nylons and the like. Again, as with the metal component, the flexibility in the plastic material may arise from the inherent flexibility of the material or from the structure of the material. By way of example, a plastic may be used which is inherently stiff but the structure could be given the appropriate flexibility by incorporating either mechanical joints between alternating sections of non-flexible plastic or by including a plurality of structures such as bellows-like portions to provide the appropriate flexibility.

From a close comparison of FIG. 5C and FIG. 1, it will be observed that the configuration of the device 110 shown in FIG. 5C is different from the configuration of the device shown in FIG. 1. The difference in configuration illustrated arises from the desirable property of resilience in the elongate member 12. It is most desirable that the elongate endless member be made from material which is resilient. Resilient in this context means that the material would tend to move toward a less curved condition. Thus, with reference to FIG. 3, the loop configuration 16 is shown with the first portion 18 overlying the second portion 20. As shown in FIG. 3 there is a general radius R defining the curve (which need not be circular) of the loop configuration 16. If the first portion 18 and the second portion 20 were not otherwise restrained, the resilience of the loop configuration 16 is such that the portion 18 would move to the right in FIG. 3 and the portion 20 would move to the left, thereby increasing the general radius of curvature R. If the material has significant resilience, then the portion 14 shown in FIG. 3 might well return to a substantially linear configuration similar to that shown in FIG. 4. It is not necessary however that the resiliency be great enough to return the material to a linear condition, rather only that the material have sufficient resiliency that it has a tendency to expand the radius of curvature.

With the above description in mind, attention is then redirected towards FIG. 1. As will be evident from reviewing FIG. 1 there are three general areas identified as 200, 202 and 204. Each such area represents a place where a portion of the member 12 overlies another portion of the member 12. The portions are in contact with one another substantially adjacent the areas designated 200, 202 and 204. In each case the resilience of the member 12 causes each loop configuration to attempt to expand outwardly. Each loop configuration however is constrained from further expansion outwardly by reason of the contact between the overlapping portions at locations 200, 202 and 204 illustrated in FIG. 1. By comparison, the orientation of the member 112 shown in FIG. 5C is a theoretical configuration of the member 112. If the member 112 has resiliency, it would not remain in the non-contacting condition illustrated in FIG. 5C. Rather, resiliency would cause the portion labelled 210 to move into contact with the portion labelled 212. Similarly, the portion 214 would expand outwardly to contact the portion 216 and the portion 218 would expand outwardly to contact the portion 220, all as illustrated in FIG. 5C.

Figure 6:
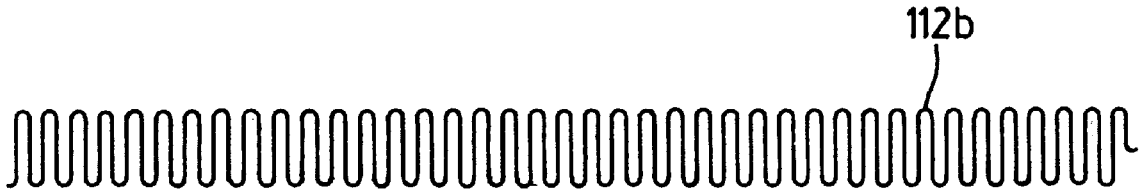
FIG. 6 illustrates a preferred material from which a device similar to that in FIGS. 1 and 2 may be constructed.

A particularly useful structure to be used to make the device 10 illustrated in FIG. 1 is a simple length of coil spring. Such a coil spring 112B is shown in FIG. 6. The coil spring advantageously has a length of approximately 20 inches. The diameter of the coil spring is approximately ½ inch. Such a spring is commonly used as a screen door retaining spring and is primarily intended to be a spring which is stretched when the door is opened. By following the steps outlined in FIGS. 5A, 5B and 5C and joining the ends of the spring together, a device as illustrated in FIG. 10 may be manufactured wherein the endless elongate member is formed from a coil spring. The spring having a prejoined linear length of approximately 20 inches when formed according to the steps shown in FIGS. 5B and 5C may have an overall diameter of approximately four inches. Such spring fits comfortably into the hand of an adult and provides a pleasing device for exercising the hand.

In use, the device may be manipulated in a number of ways. With reference to FIG. 1, the portion illustrated at 300 may be moved rearwardly, that is, into the page by one finger or digit while the portion indicated generally at 302 is moved outwardly from the page. This motion results in a deformation of the device without in fact ultimately changing its shape. Notwithstanding the deformation by manipulation of the fingers of the hand, the device remains in essentially the same shape. However, the points of contact 200, 202 and 204 do move about the circumference of the loops.

A second means of manipulating the device comprises applying force in the direction of the arrow P illustrated in FIG. 1, while otherwise supporting the device 10 at another portion or portions of the endless member 12. For reference, a portion of the endless device 12 is indicated by an X and labelled 400 in FIG. 1. As the force is applied in the direction of arrow P in FIG. 1, the location X on the endless member 12 will move away from the force P. The spot 400 will continuously move about the shape and will successively move about the loops 116, 116*b* and 116*c*, ultimately returning to the starting point as the device is continuously manipulated. Throughout the manipulation however the device 10 will always have substantially the same shape as shown in FIG. 1. In order to facilitate this type of manipulation, the device is manufactured from a material which can be loaded in compression. Thus, applying the force P as shown in FIG. 1 pushes on a portion of the member 12. As the device is continuously manipulated, the compressive force applied in the direction of P is communicated around the entire length of the endless member 12 so that the spot 400 continues to be pushed around all possible locations of the member 12. It is possible to apply this compressive force because of the resilience of the member 12. By contrast, it may be observed, that if such a device were manufactured from a piece of string or an elastic band, there would be the requisite flexibility but there would not be the requisite resilience. The requisite resilience, however, might be created even in the case of an elastomeric member or a rope simply by the property of the elastomeric member or rope itself such that it can be loaded at least in a certain minimum mount in compression. This might arise for instance if a rope were sufficiently large in diameter and sufficiently stiff that it would exhibit the resilience as described herein so that the loop configuration would attempt to expand outwardly. This may arise simply by reason of the bending of the thickness of the material whether it be in the form of an elastomeric band or in the form of a rope such as a polypropylene or nylon rope or the like.

The device can be continuously manipulated in the manners explained above. The force P described above may be applied at any point around the member 12. In addition, the device can be manipulated in any other manner desired such as by twisting various portions of the endless elongate member. However, regardless of how manipulated, when the device is released, it will return to the particular shape illustrated in FIG. 1.

Figure 2:
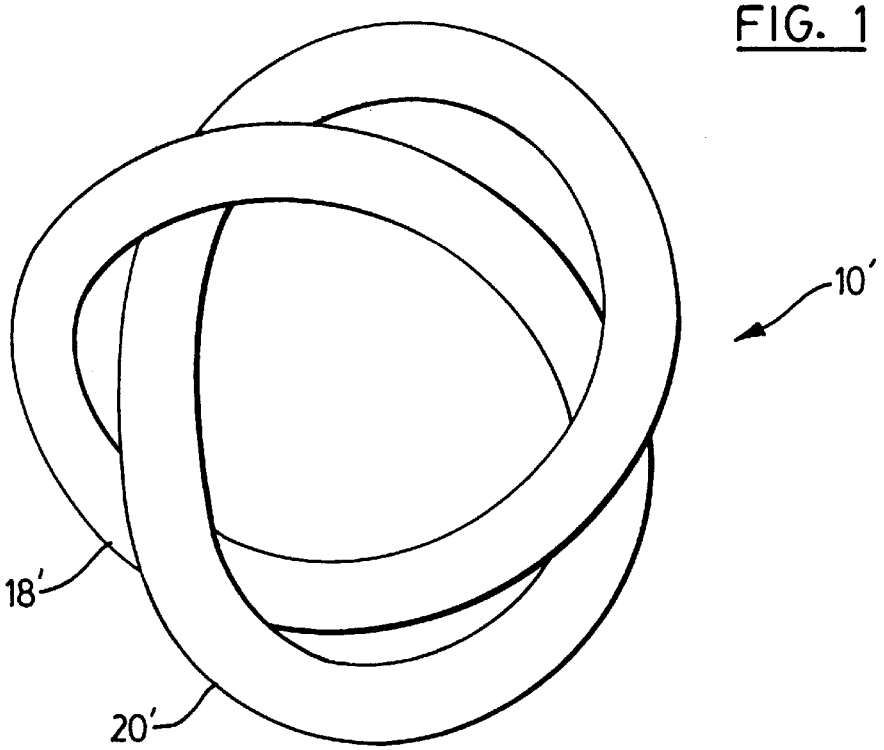
FIG. 2 illustrates an embodiment which is similar to FIG. 1 but is the inverse of FIG. 1.

The device 10' illustrated in FIG. 2 is essentially the inverse of the device shown in FIG. 1. As shown in FIG. 3, the portion 18 overlies the portion 20. FIGS. 5A, 5B and 5C illustrate the completion of the manufacturing of the device. The device shown in FIG. 2 is simply the inverse. To manufacture such a device, a portion 18' would underlie a portion 20'. The completion of the manufacturing would then involve the inverse of the steps shown in FIGS. 5B and 5C. On joining the two ends of the elongate endless member, the device as shown in FIG. 2 would be created. Both the devices illustrated in FIGS. 1 and 2 comprise an endless elongate member having a loop configuration with a portion of the member extending through the loop.

Figure 7:
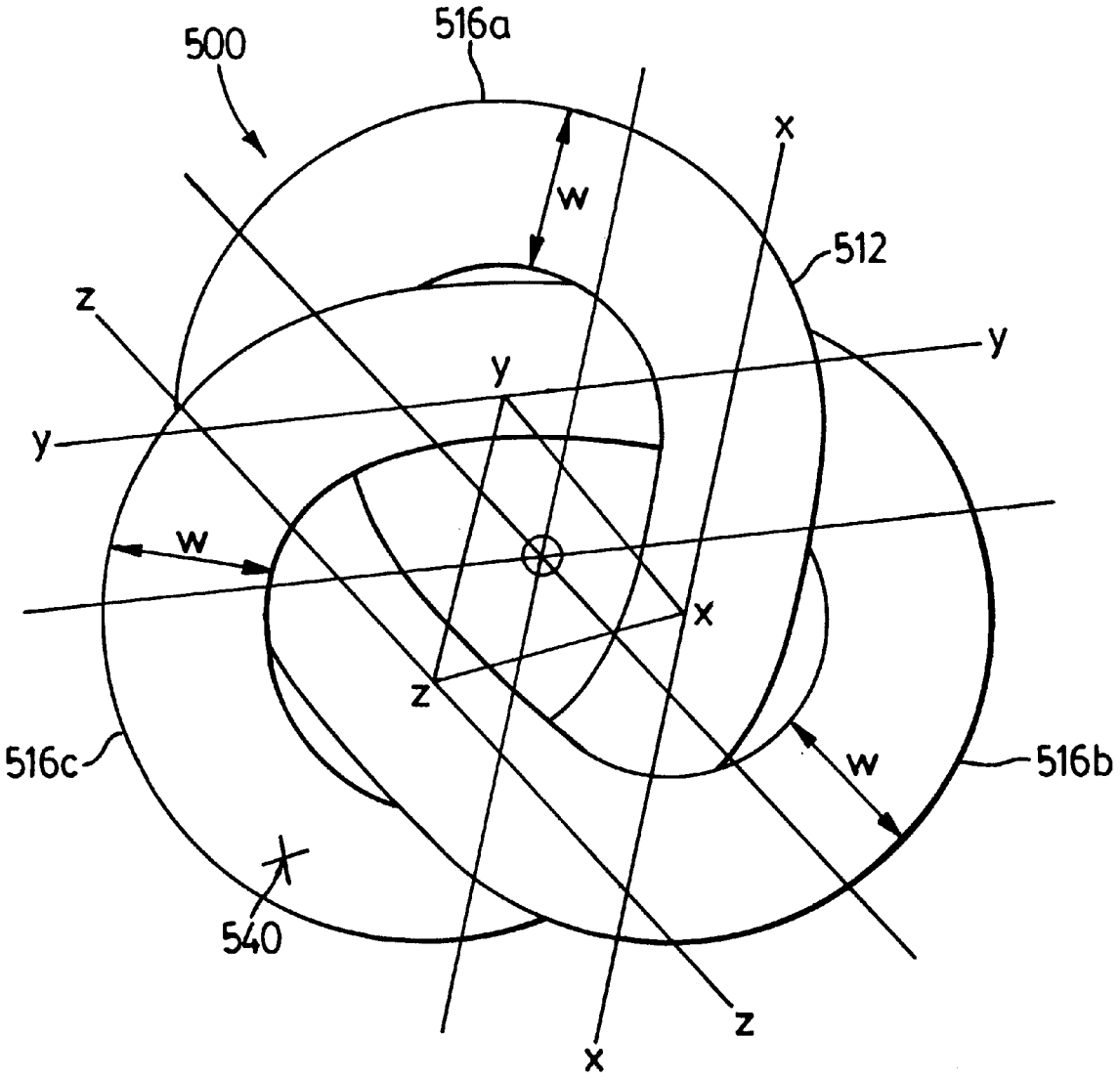
FIG. 7 illustrates another embodiment of the invention.

The embodiment illustrated in FIG. 7 is similar to the embodiment shown in FIG. 1. The embodiment is shown generally at 500. The device 500 is comprised of a continuous, flexible member 512. The member 512 comprises several sections. The member 512 comprises a loop 516*a*. In addition, the endless member 512 comprises additional loops 516*b* and 516*c*.

Each of the loops 516*a,* 516*b* and 516*c* are three dimensional portions of the endless member 512. Each loop portion 516*a,* 516*b* and 516*c,* viewed substantially as a two dimensional member, in essence can be thought of as existing substantially in a plane comprised of the coordinates x,y for loop 516*a,* y,z for the loop 516*b* and x,z for the loop 516*c*. Similar to the device shown in FIGS. 1 and 2, each of the loops when viewed visually as a two dimensional object appears to have a portion of the endless member 512 extending generally centrally through each such loop.

It is important, however, notwithstanding the description set out above, to recognize that each of the loops 516*a*, 516*b* and 516*c* are not in fact two dimensional loops, but rather, are curved in three dimensions. In fact, the radius of curvature as measured in three dimensions is constant along the entire length of the member 512. The principal difference between the embodiment illustrated in FIG. 7 and the embodiments illustrated in FIGS. 1 and 2 is that there is no contact between any portion of the endless member 512 with any other portion of the member 512 when the device is in the non-deformed configuration. The "memory" of each portion of member 512 is such that the member 512 will return to the configuration illustrated when unrestrained.

The device illustrated in FIG. 7 may be manufactured from materials which are thermosettable but flexible. For instance, certain rubbers and plastics may be thermoset to the desired configuration as illustrated in FIG. 7. In order to do this, a mold may be made having a cavity of the configuration as shown in FIG. 7. Rubber or plastic materials may be then injected into the mold and cured under suitable heat condition. The molds may then be opened and the part removed with any necessary flash removed.

Because the part is resilient, it may be deformed in any direction or degree. However, once deformed, because the material is resilient and has "memory", it will return to the configuration as illustrated in FIG. 7.

The device of FIG. 7 may be hand manipulated and deformed similar to the deformation discussed above with respect to the device of FIGS. 1 and 2. The deformation may take place in any manner by manipulating the device as desired by the hand. However, when the manipulating force is removed, the device returns to the configuration as illustrated in FIG. 1.

In particular, the device illustrated in FIG. 7 may be deformed by applying a force at any point along the endless member 12 in a direction which is essentially along the axis of the member 512 to load a portion of the member 512 in compression as discussed above with respect to FIGS. 1 and 2. If a theoretical spot identified as 540 in FIG. 7 were to be visually noted, then as a push/pull force is applied along the general axis of the member 512, that spot 540 will appear to move along the endless path defined by the general axis of the member 512. Because each finite length of the member 512 has the same configuration, the overall shape and appearance of the device will not change from that shown in FIG. 7. Rather the spot will appear to move along the endless path defined by the member 512 assuming all locations along that path. In this sense, the spot 540 will appear to move along the endless path from an initial point throughout the length of the path and return to the spot of commencement.

It should be recognized that the device shown in FIG. 7 may also be deformed in any other manner. Following deformation, the device will then return to its memory configuration as shown in FIG. 7. It should also be noted that just as FIG. 2 is an inverse of the device of FIG. 1, there is an inverse configuration of the device illustrated in FIG. 7, although this has not been illustrated herein.

While the device shown in FIG. 7 is also suitable for hand manipulation, strength and coordination building as discussed above, the device shown in FIG. 7 may also be used as a toy somewhat similar to an irregular shaped ball. The device could be thrown against a flat surface such as a floor or wall. On deformation, energy would be stored in the device which would then be released as the device reflects off the wall similar to any other form of compressible, spherical ball. However, the angle of reflection from the wall would be largely unpredictable as it is not directly related solely to the trajectory of the device towards the flat surface. Depending upon the portion of the device that first contacts the wall, the angle of incidence would vary dramatically for a fixed trajectory. This gives a device whose reflection angle from a flat surface cannot be predicted solely by reference to the trajectory, rather the angle of reflection is a function of the trajectory and the shape of the portion of the device that actually contacts the reflecting surface.

The device may be decorated in any suitable pattern or left plain. Decorating the device with a suitable pattern such as by the application of beads or the like to the endless member provides an apparent motion as the device is manipulated. Any particular spot can be followed as it apparently moves about the configuration of loops and overlying and underlying portions, thus adding visually to the tactile sensations arising from manipulation of the device itself. The device thus serves as a toy of fascination as well as providing a continuous opportunity for manipulation of the joints of the fingers during continuous manipulation.

While a particular embodiment has been illustrated herein, such embodiments are by way of exemplification only. The scope of the invention is not to be limited by these embodiments but rather as set out in the appendix claims. The device can be made in any desired size. Smaller devices may be better suited to smaller size hands. Also, the device could be made much longer, even as tall as a person so that manipulation occurs using arms and legs.

I claim:

1. A manipulable device, said device comprising an endless elongate member having a particular shape, said shape comprising a plurality of sections comprising a generally looped shape configuration in 3 dimensions, wherein each finite element along the length of the shape has the same configuration and is continuously curved in 3 dimensions, and said endless member is flexible and has resilience and memory and said resilience and memory is such that said member will return to said shape when said member is deformed from said shape and then released.

2. A manipulable device, said device comprising an endless elongate member having a particular shape, wherein said endless elongate member is continuously curved, and wherein said endless elongate member is flexible and has resilience and said resilience is such that the radius of said curvature of said endless elongate member would tend to increase if said member were not restrained, and wherein said particular shape is the shape of a knot of three crossings, so that each overcrossing is followed by an undercrossing and each undercrossing is followed by an overcrossing.

3. The device of claim 2 wherein said elongate member is metallic.

4. The device of claim 3 wherein said elongate member is a spring.

5. The device of claim 4 wherein said elongate member is a coil spring.

6. The device of claim 2 wherein said elongate member is plastic.

7. The device of claim 6 wherein said elongate member is a polymeric spring.

8. The device of claim 2 wherein said elongate member has flexibility, resilience and compressive strength so that a compressive force applied axially to a portion of said member is communicated to all other portions of said member.

9. The device of claim 2 wherein said device comprises markings on said elongate member so that, upon manipulation, said marking appears to move with respect to said loop configuration.

* * * * *